US010752038B2

(12) United States Patent
Peleman

(10) Patent No.: US 10,752,038 B2
(45) Date of Patent: Aug. 25, 2020

(54) BINDING FOLDER FOR THE BINDING OF A BUNDLE OF LEAVES

(71) Applicant: PELEMAN INDUSTRIES, NAAMLOZE VENNOOTSCHAP, Puurs (BE)

(72) Inventor: Guido Frans M Peleman, Knokke-Heist (BE)

(73) Assignee: PELEMAN INDUSTRIES, NAAMLOZE VENNOOTSCHAP, Puurs (BE)

( * ) Notice: Subject to any disclaimer, the term of this patent is extended or adjusted under 35 U.S.C. 154(b) by 0 days.

(21) Appl. No.: 16/607,750

(22) PCT Filed: Apr. 10, 2018

(86) PCT No.: PCT/IB2018/052490
§ 371 (c)(1),
(2) Date: Oct. 24, 2019

(87) PCT Pub. No.: WO2018/203160
PCT Pub. Date: Nov. 8, 2018

(65) Prior Publication Data

US 2020/0094606 A1 Mar. 26, 2020

(30) Foreign Application Priority Data

May 5, 2017 (BE) ..... 2017/5318

(51) Int. Cl.
*B42D 3/00* (2006.01)
*B42D 3/02* (2006.01)

(52) U.S. Cl.
CPC ..... *B42D 3/002* (2013.01); *B42D 3/02* (2013.01)

(58) Field of Classification Search
USPC ..... 402/4, 8, 19, 20, 21, 24, 25, 70, 71, 73, 402/74, 75, 76, 77, 78, 500
See application file for complete search history.

(56) References Cited

U.S. PATENT DOCUMENTS

2014/0079464 A1* 3/2014 Hoarau ..... B42F 1/006 402/68

FOREIGN PATENT DOCUMENTS

| | | | |
|---|---|---|---|
| BE | 1019630 | A3 | 9/2012 |
| DE | 202013100357 | U1 | 1/2013 |
| EP | 1637233 | A2 | 3/2006 |
| EP | 1637344 | A2 | 3/2006 |

(Continued)

OTHER PUBLICATIONS

International Search Report, dated Jun. 1, 2018, from corresponding PCT application No. PCT/IB2018/052490.

(Continued)

*Primary Examiner* — Justin V Lewis
(74) *Attorney, Agent, or Firm* — Young & Thompson

(57) ABSTRACT

Binding folder for the binding of a bundle of leaves, which binding folder essentially consists of a spine with at least one cover sheet, whereby the spine includes a U-shaped profile with a bottom and two upright arms, whereby the cover sheet is attached to one of the arms, whereby the binding folder is provided with a layer of glue to attach the bundle of leaves in the binding folder. The layer of glue is put on the arm or a rigid extension of the arm such that the layer of glue in relation to the U-shaped profile cannot be folded or moved.

18 Claims, 3 Drawing Sheets

(56) References Cited

FOREIGN PATENT DOCUMENTS

Figure 1:
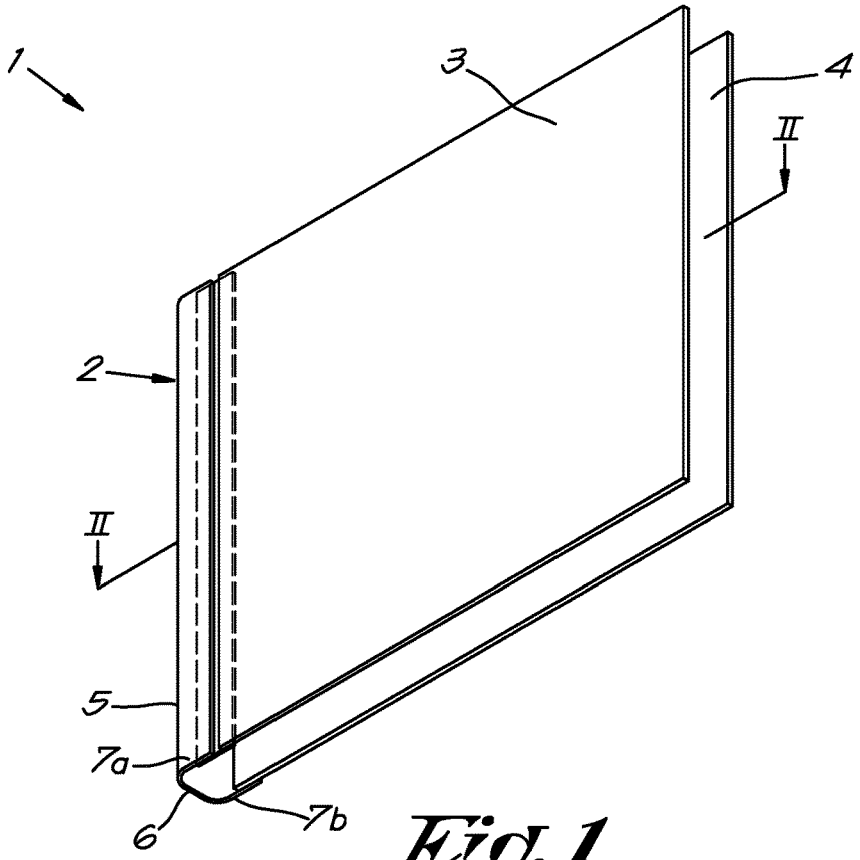

| | | | | | |
|---|---|---|---|---|---|
| WO | 2011/004245 | A1 | | 1/2011 | |
| WO | WO-2011004245 | A1 | * | 1/2011 | ..... B42B 5/06 |
| WO | 2012/168775 | A1 | | 12/2012 | |

OTHER PUBLICATIONS

Written Opinion, dated Jun. 1, 2018, from corresponding PCT application No. PCT/IB2018/052490.

* cited by examiner

BINDING FOLDER FOR THE BINDING OF A BUNDLE OF LEAVES

The current invention relates to a binding folder for binding leaves.

It is known to bind a bundle of leaves in a binding folder with a spine and two cover sheets, such that the bundle is not only protected by the binding folder but can also be professionally presented.

Such binding folder is used to bind a bundle of leaves, whereby the bundle is put in the U-shaped profile of the spine with a side edge to be bound and for example can be clamped in by folding the arms of the spine toward each other or can be glued in the spine by means of a layer of hotmelt adhesive.

A disadvantage of this is that a special machine needs to be provided which can fold the arms of the spine or melt the layer of glue in the spine.

Binding folders are also known which are provided with a layer or strip of self-adhesive glue on the cover sheets with which the bundle, after having been applied in the binding folder, can be attached to the cover sheets.

However, a disadvantage of such known binding folder is that the layer of glue prevents opening the bound bundle easily. The bound bundle is not user-friendly.

In case of frequent use the bundle can even detach from the cover sheets of the binding folder.

To solve this problem, special reinforced leaves are used for the outermost leaves of the bundle. This solution is expensive of course and also laborious because for the binding of a bundle two reinforced leaves always need to be provided.

Another solution is putting the self-adhesive glue on the outermost leaves of the bundle, instead of on the cover sheets of the binding folder.

A disadvantage of this is that special leaves with glue also need to be provided, which makes the system more difficult and more expensive.

The purpose of the present invention is to provide a solution to at least one of the aforementioned and other disadvantages.

The object of the present invention is a binding folder for the binding of a bundle of leaves, whereby the binding folder essentially consists of a spine with at least one cover sheet, whereby the spine comprises a U-shaped profile with a bottom and two upright arms, whereby the cover sheet is attached to one of the arms, whereby the binding folder is provided with a layer of glue to attach the bundle of leaves in the binding folder, characterised in that the layer of glue is put on a rigid extension of said arm such that the layer of glue in relation to the U-shaped profile cannot be folded or moved.

This provides the advantage that, because said layer of glue cannot move in relation to the spine, the bundle of leaves cannot detach from the layer of glue. Indeed, no force or tension will be exercised on the layer of glue.

Yet another advantage consists in that the bundle of leaves does not have to be provided with special reinforced leaves or special leaves with a layer of glue, such that these extra costs can be avoided.

Another aspect relates to a binding folder according to the invention, but characterised in that the layer of glue is applied on said arm such that the layer of glue in relation to the U-shaped profile cannot be folded or moved.

In a practical embodiment, said arm of the spine is longer than the other arm, whereby the layer of glue is applied on or on the level of the extended part of said arm.

The consequence is that the layer of glue is applied on the arm itself or on the level of this arm, if the cover sheet is attached to this arm with an overlapping edge on the inside of the spine.

Alternatively, it is possible that the rigid extension of said arm is realised by attaching the cover sheet with a rigid or stiff adhesion to said arm, whereby the layer of glue is applied on the level of this rigid or stiff adhesion.

To realise the rigid or stiff adhesion, or the flexible adhesion, a person skilled in the art has several options.

In a practical embodiment, said rigid or stiff adhesion is realised because the second cover sheet is made of a rigid material, whereby the cover sheet is attached to the arm of the rigid U-shaped profile with an overlapping edge.

Alternatively, said rigid or stiff adhesion can be realised because one arm of the spine is longer than the other arm, whereby the second cover sheet is attached to the arm with an overlapping edge.

Although in this case a non-symmetrical spine is needed, the advantage of this embodiment is that also thicker materials, such as cardboard or stiff thicker plastic sheets can be used for the second cover sheet. Indeed, because of the lower arm, the overlapping edge will be greater, such that the attachment of this second cover sheet will be more solid or stronger.

In a preferred embodiment, the binding folder is provided with two cover sheets, whereby a first cover sheet is attached to a first arm of the spine with a flexible adhesion such that this first cover sheet in relation to this first arm can be folded open, whereby the second cover sheet is applied to the second arm, whereby on this second arm or on a rigid extension thereof, said layer of glue is applied.

It is clear that the first cover sheet will preferably be used as the front of the binding folder.

This provides the advantage that the flexible adhesion of the first cover sheet will make it possible to easily leaf through the bundle.

In a practical embodiment the flexible connection is realised by means of a flat, strip-shaped part that is fixed to an edge of the first cover sheet and that is more flexible than said first cover sheet, whereby the first cover sheet is fixed against an arm of the U-shaped spine with the strip-shaped part.

This provides the advantage that by means of the flexible strip, the first cover sheet can be easily folded over or opened in relation to the spine or the bundle attached in the binding folder. It will be possible hereby that the first cover sheet itself is made of a thicker and stronger material, such that it is better protected against wear and tear when used.

Alternatively, the flexible connection can be realised because the first cover sheet is located in the extension of the arm, whereby a coating is provided at least around the first cover sheet and arm, such that between the arm and the first cover sheet a kind of hinge is created.

This provides the advantage that the coating does not only allow for the flexible adhesion, but also for a decorative finish. Depending on the material of the coating, a dirt or moisture-repellent finish of the binding folder can also be realised.

Figure 2:
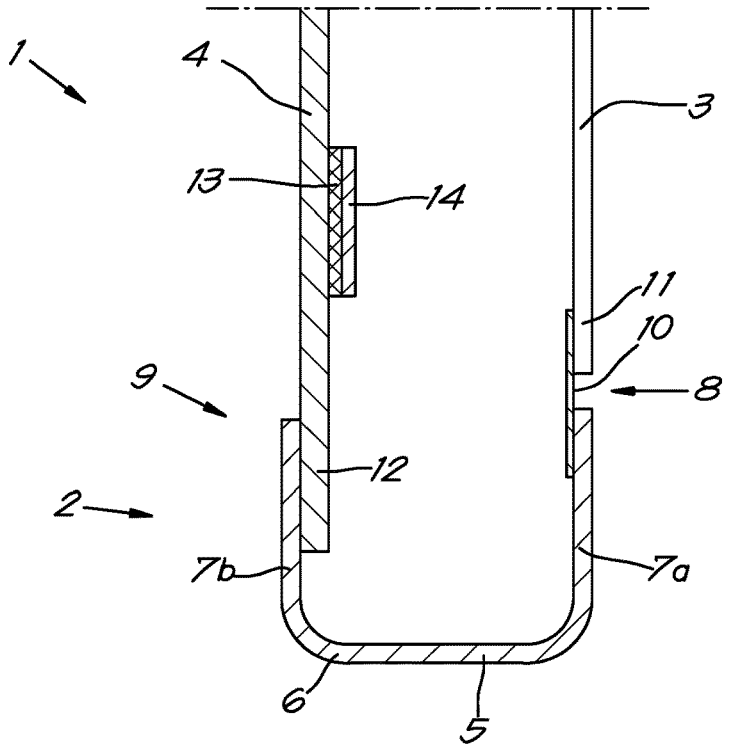
Figure 3:
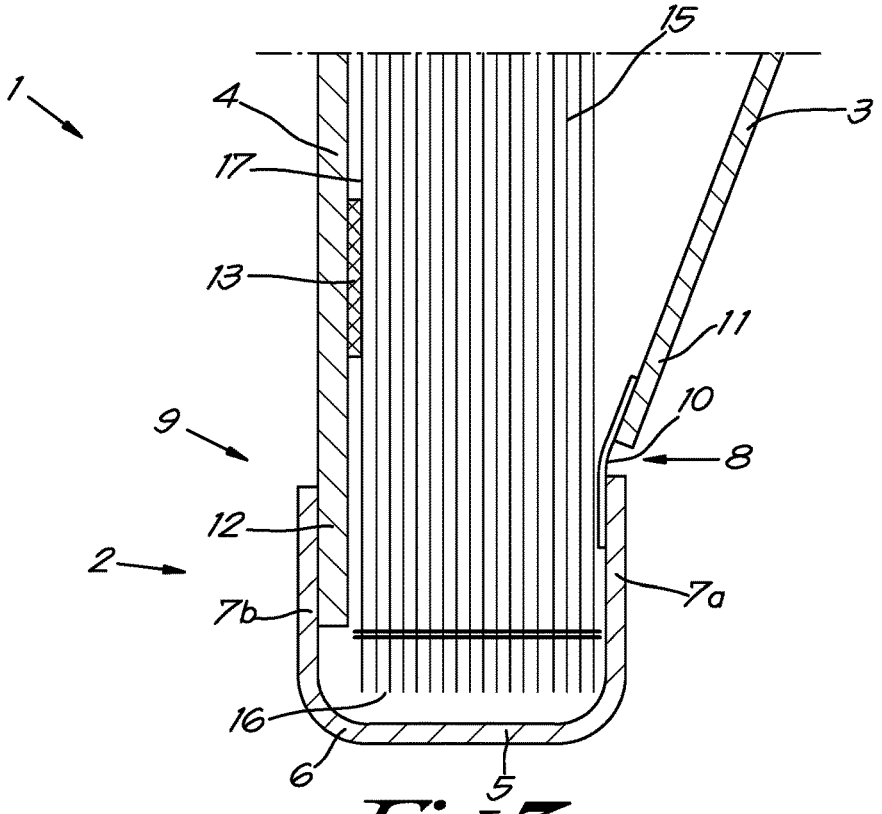
Figure 4:
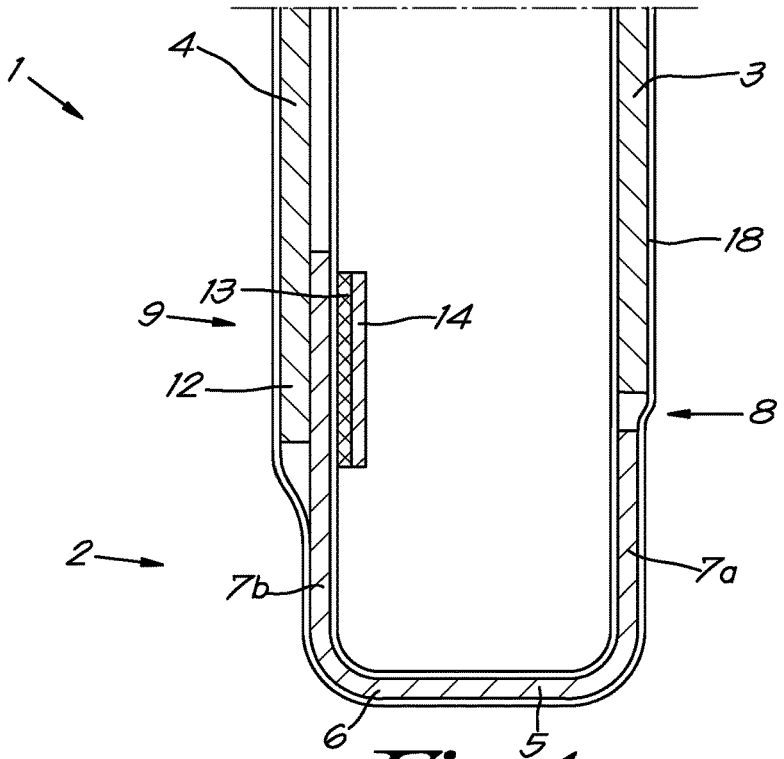
Figure 5:
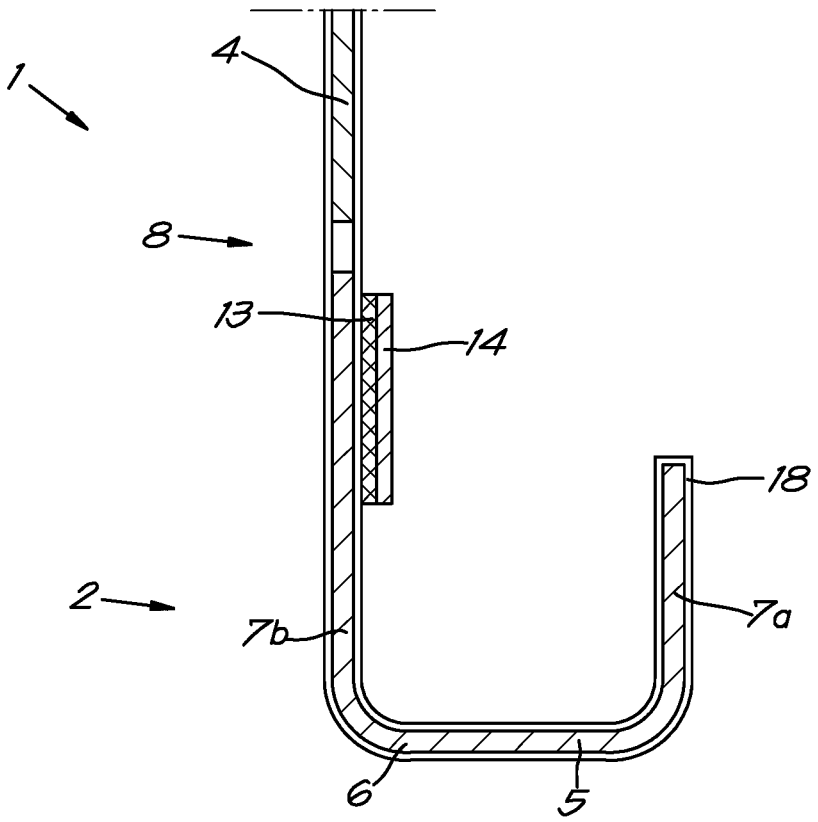

With the intention of better showing the characteristics of the invention, a few preferred embodiments of a binding folder according to the invention are described hereinafter by way of an example, without any limiting nature, with reference to the accompanying drawings, wherein:

FIG. 1 schematically shows a perspective view of a binding folder according to the invention;

FIG. 2 schematically shows a cross-section according to line II-II of FIG. 1;

FIG. 3 schematically shows the cross-section of FIG. 2, but with a bundle of leaves applied therein;

FIG. 4 schematically shows a variant of FIG. 2;

FIG. 5 schematically shows a variant of FIG. 4.

The binding folder 1 schematically shown in FIG. 1 essentially consists of a spine 2 and two cover sheets 3, 4.

The spine 2 is a U-shaped profile 5 with a bottom 6 and two upright arms 7*a*, 7*b*.

The U-shaped profile 5 is preferably made from a stiff or rigid material, in this case a metal, which gives the spine 2 the necessary strength.

It is possible, but not necessarily for the invention, that the spine 2 is also provided with a, for example, decorative, coating which is applied around the U-shaped profile 5.

In this case, but not necessarily, the two cover sheets 3, 4 are made of two different materials.

The first cover sheet 3, which in the shown example serves as the front of the binding folder 1, is made of a transparent, clear or translucent material, whereas the second cover sheet 4 that serves as the back of the binding folder 1, is made of an opaque or non-translucent material.

It is of course also possible that both cover sheets 3, 4 are transparent or non-translucent.

As you can see in FIG. 2, the cover sheets 3, 4 are attached to the arms 7*a*, 7*b* of the spine 2 whereby the first cover sheet 3 is attached to a first arm 7*a* with a flexible adhesion 8 such that the first cover sheet 3 in relation to this first arm 7*a* can be folded open and the second cover sheet 4 is attached to a second arm 7*b* with a rigid or stiff adhesion 9 such that the second cover sheet 4 in relation to this second arm 7*b* cannot be folded open.

In the shown example, the flexible adhesion 8 is realised by means of a flat, strip-shaped part 10 which is fixed to an edge 11 of the first cover sheet 3 and that is more flexible than said first cover sheet 3, whereby the first cover sheet 3 is fixed against an arm 7*a* of the spine 2 with the strip-shaped part 11.

The strip-shaped part 10 is hereby located on the side of the arm 7*a* that faces the inside of the spine 2.

Furthermore, said rigid or stiff adhesion 9 in the example is realised because the second cover sheet 4 is made of a stiff material, whereby the cover sheet 4 is attached to the arm 7*b* with an overlapping edge 12.

This stiff material can be thick cardboard or synthetic material, for example.

In this case, but not necessarily for the invention, the second cover sheet 4 is fixed to the side of the arm 7*b* which faces the inside of the spine 2.

On the second cover sheet 4 a layer of glue 13 is also provided to attach the bundle of leaves in the binding folder 1.

The layer of glue 13 is situated above said overlapping edge 12. Of course this is not necessary for the invention, the layer of glue 13 could also be located on the overlapping edge 12, for example.

Because in this case a self-adhesive glue is used, the layer of glue 13 is provided with a removable protective strip 14.

The layer of glue 13 can be executed as one continuous strip that runs along the entire or practically the entire length of the spine 2, but can also be executed in the form of a dotted line, i.e. an interrupted strip.

The use of the binding folder 1 is very simple and shown in FIG. 3.

First and foremost, leaves are bound to form a bundle 15. This can be done for example by stapling the leaves together along an edge 16, such as the bundle 15 of FIG. 3.

It is of course also possible that the bundle 15 is sewed or glued.

Subsequently, the protective strip 14 of the layer of glue 13 is removed. The bundle 15 is then put with the bound edge 16 in the spine 2 of the binding folder 1.

It is of course not excluded that the bundle 15 is first put with the bound edge 16 in the spine 2 and that the protective strip 14 of the layer of glue 13 is only removed afterwards.

The layer of glue 13 is then pressed against the bundle of leaves 15, by pressing the second cover sheet 4 against the bundle 15. This causes the layer of glue 13 to stick against the outermost leaf 17 of the bundle 15, such that the bundle 15 in the binding folder 1 can be attached as shown in FIG. 3.

As is also apparent from this figure, the first cover sheet 3 can be easily folded open in relation to the spine 2 and the bundle 15 bound in the spine 2 by means of the flexible adhesion 8.

Thus, it is easy to leaf through the bundle 15.

As the second cover sheet 4 is fixed to the spine 2 with a rigid or stiff adhesion 9, this cover sheet 4 will not or barely be able to move in relation to the spine 2. This means the second, outermost cover sheet 4 cannot be folded open.

Consequently, there will be no tension on the connection between the second cover sheet 4 and the bound bundle 15, such that there is no risk of the layer of glue 13 detaching and consequently of the bound bundle 15 detaching from the binding folder 1.

FIG. 4 shows a variant according to FIG. 2, whereby in this case said rigid or stiff adhesion 9 is realised because one arm 7*b* of the spine 2 is longer than the other arm 7*a*, whereby the second cover sheet 4 is attached to the arm 7*b* with an overlapping edge 12.

The second cover sheet 4 is hereby fixed to the side of the arm 7*b* that faces the outside of the spine 2.

The flexible connection 8 is in this case realised because the first cover sheet 3 is located in the extension of the arm 7*a*, whereby a coating 18 is provided at least around the first cover sheet 3 and the arm 7*a*, such that between the arm 7*a* and the first cover sheet 3 a kind of hinge is created.

In this case, but not necessarily, the coating 18 is provided around both cover sheets 3, 4 and the whole spine 2.

This coating 18 can have a decorative print, colour or finish. The material can also be chosen to be water- or dirt-repellent for example.

The layer of glue 13 is situated on said overlapping edge 12.

For the rest the embodiment of FIG. 4 and the use thereof is the same as FIG. 2.

It is clear than in an alternative embodiment of a binding folder 1 according to the invention the rigid adhesion 9 of FIG. 4 can be combined with the flexible adhesion 8 of FIG. 2. The rigid adhesion 9 of FIG. 2 can also be combined with the flexible adhesion 8 of FIG. 4.

In all embodiments shown and described above it is possible that the first cover sheet 3 is left out, i.e. the front of the binding folder 1, whereby a binding folder 1 remains that consists of one cover sheet 4 that is attached to the spine 2.

FIG. 5 shows another variant of a binding folder 1 with one single cover sheet 4, as a variant of FIG. 4.

Here the first cover sheet 3 is left out, and the second cover sheet 4 is applied to the longer arm 7*b* with a flexible adhesion 8, in the same way as the flexible adhesion 8 of FIG. 4.

This means that the cover sheet 4 is located in the extension of the longer arm 7*b*, whereby a coating 18 is provided at least around the cover sheet 4 and the arm 7*b*, such that between the arm 7*b* and the first cover sheet 4 a kind of hinge is created.

It is also possible that the flexible adhesion between the longer arm 7*b* and the cover sheet 4 of FIG. 5 is realised by means of a flat, strip-shaped part 10 that is fixed to an edge 11 of the cover sheet 4 and that is more flexible than said cover sheet 4, whereby the cover sheet 4 is fixed against an arm 7*b* of the spine 2 with the strip-shaped part 11.

Note that in the variant of FIG. 5, and all described alternatives of FIG. 5, the layer of glue 13 will always be situated on the level of the arm 7*b*, more specifically the extended part thereof.

The flexible adhesion 8 for the attachment of the cover sheet 4 on the extended arm 7*b* can also be applied in FIG. 4. Note that this corresponds with the application of an additional cover sheet 3 in the embodiment of FIG. 5, such that a binding folder 1 can be realised with two cover sheets 3, 4.

The present invention is by no means limited to the embodiments described as an example and shown in the drawings, but a binding folder according to the invention can be realised in all kinds of forms and dimensions, without departing from the scope of the invention.

The invention claimed is:

1. Binding folder for binding a bundle of leaves (15), which binding folder (1) essentially consists of a spine (2) with at least one cover sheet (4), wherein the spine (2) comprises a U-shaped profile (5) with a bottom (6) and two upright arms (7*a*, 7*b*), wherein the cover sheet (4) is attached to one of the arms (7*b*), wherein the binding folder (1) is provided with a layer of glue (13) to attach the bundle of leaves (15) in the binding folder (1), wherein the layer of glue (13) is applied on a rigid extension of said arm (7*b*) such that the layer of glue (13) cannot be folded or moved relative to the U-shaped profile (5), wherein the rigid extension of said arm (7*b*) is realized by:

said arm (7*b*) of the spine (2) being longer than the other arm (7*a*), wherein the layer of glue (13) is applied onto or on a level of an extended part of said arm (7*b*); or by:

attaching the cover sheet (4) to said arm (7*b*) with a rigid or stiff adhesion (9), wherein the layer of glue (13) is applied on a level of this rigid or stiff adhesion (9);

wherein said rigid or stiff adhesion (9) is realised because one arm (7*b*) of the spine (2) is longer than the other arm (7*a*), whereby the cover sheet (4) is attached to the longer arm (7*b*) with an overlapping edge (12) of the cover sheet (4).

2. Binding folder according to claim 1, wherein said rigid or stiff adhesion (9) is realised because the cover sheet (4) is made of a stiff material, whereby the cover sheet (4) is attached to the arm (7*b*) with an overlapping edge (12) of the cover sheet (4).

3. Binding folder according to claim 2, wherein the cover sheet (4) is fixed to a side of the arm (7*b*) facing inwardly of the spine (2).

4. Binding folder according to claim 2, wherein the cover sheet (4) is fixed to a side of the arm (7*b*) facing outwardly of the spine (2).

5. Binding folder according to claim 1, wherein the binding folder is provided with two cover sheets (3, 4), wherein a first cover sheet (3) is attached to a first arm (7*a*) with a flexible adhesion (8), such that this first cover sheet can be folded open relative to said first arm (7*a*), wherein the second cover sheet (4) is attached to the second arm (7*b*), wherein on this second arm (7*b*) or on a rigid extension thereof, said layer of glue (13) is applied.

6. Binding folder according to claim 5, wherein the flexible adhesion (8) is realised by means of a flat, strip-shaped part (10) that is fixed to an edge (11) of the first cover sheet (3) and that is more flexible than said first cover sheet (3), wherein the first cover sheet (3) is fixed against the first arm (7*a*) of the U-shaped spine (2) with the strip-shaped part (10).

7. Binding folder according to claim 5, wherein the flexible adhesion (8) is realised because the first cover sheet is located (3) in an extension of the first arm (7*a*), wherein a coating (18) is provided at least around the first cover sheet (3) and first arm (7*a*), such that between the first arm (7*a*) and the first cover sheet (3) a hinge is created.

8. Binding folder according to claim 7, wherein the coating (18) is provided around both cover sheets (3, 4) and the spine (2).

9. Binding folder according to claim 2, wherein the layer of glue (13) is situated on said overlapping edge (12).

10. Binding folder according to claim 1, wherein the layer of glue (13) is provided with a protective strip (14).

11. Binding folder according to claim 1, wherein the glue is applied as a strip or as a dotted line.

12. Binding folder according to claim 1, wherein the first cover sheet (3) is made of a transparent, translucent or clear material and that the second cover sheet (4) is made of an opaque or non-translucent material.

13. Binding folder according to claim 1, wherein the U-shaped profile (5) is made of a stiff or rigid material.

14. Binding folder according to claim 2, wherein the binding folder is provided with two cover sheets (3, 4), wherein a first cover sheet (3) is attached to a first arm (7*a*) with a flexible adhesion (8), such that this first cover sheet can be folded open relative to said first arm (7*a*), wherein the second cover sheet (4) is attached to the second arm (7*b*), wherein on this second arm (7*b*) or on a rigid extension thereof, said layer of glue (13) is applied.

15. Binding folder according to claim 3, wherein the binding folder is provided with two cover sheets (3, 4), wherein a first cover sheet (3) is attached to a first arm (7*a*) with a flexible adhesion (8), such that this first cover sheet can be folded open relative to said first arm (7*a*), wherein the second cover sheet (4) is attached to the second arm (7*b*), wherein on this second arm (7*b*) or on a rigid extension thereof, said layer of glue (13) is applied.

16. Binding folder according to claim 4, wherein the binding folder is provided with two cover sheets (3, 4), wherein a first cover sheet (3) is attached to a first arm (7*a*) with a flexible adhesion (8), such that this first cover sheet can be folded open relative to said first arm (7*a*), wherein the second cover sheet (4) is attached to the second arm (7*b*), wherein on this second arm (7*b*) or on a rigid extension thereof, said layer of glue (13) is applied.

17. Binding folder for binding a bundle of leaves (15), which binding folder (1) essentially consists of a spine (2) with at least one cover sheet (4), wherein the spine (2) comprises a U-shaped profile (5) with a bottom (6) and two upright arms (7*a*, 7*b*), wherein the cover sheet (4) is attached to one of the arms (7*b*), wherein the binding folder (1) is provided with a layer of glue (13) to attach the bundle of leaves (15) in the binding folder (1), wherein the layer of glue (13) is applied on a rigid extension of said arm (7*b*)

such that the layer of glue (13) cannot be folded or moved relative to the U-shaped profile (5), wherein the rigid extension of said arm (7*b*) is realized by:

said arm (7*b*) of the spine (2) being longer than the other arm (7*a*), wherein the layer of glue (13) is applied onto or on a level of an extended part of said arm (7*b*); or by:

attaching the cover sheet (4) to said arm (7*b*) with a rigid or stiff adhesion (9), wherein the layer of glue (13) is applied on a level of this rigid or stiff adhesion (9);

wherein the binding folder is provided with two cover sheets (3, 4), wherein a first cover sheet (3) is attached to a first arm (7*a*) with a flexible adhesion (8), such that this first cover sheet can be folded open relative to said first arm (7*a*), wherein the second cover sheet (4) is attached to the second arm (7*b*), wherein on this second arm (7*b*) or on a rigid extension thereof, said layer of glue (13) is applied;

wherein the flexible adhesion (8) is realised by means of a flat, strip-shaped part (10) that is fixed to an edge (11) of the first cover sheet (3) and that is more flexible than said first cover sheet (3), wherein the first cover sheet (3) is fixed against the first arm (7*a*) of the U-shaped spine (2) with the strip-shaped part (10).

18. Binding folder for binding a bundle of leaves (15), which binding folder (1) essentially consists of a spine (2) with at least one cover sheet (4), wherein the spine (2) comprises a U-shaped profile (5) with a bottom (6) and two upright arms (7*a*, 7*b*), wherein the cover sheet (4) is attached to one of the arms (7*b*), wherein the binding folder (1) is provided with a layer of glue (13) to attach the bundle of leaves (15) in the binding folder (1), wherein the layer of glue (13) is applied on a rigid extension of said arm (7*b*) such that the layer of glue (13) cannot be folded or moved relative to the U-shaped profile (5), wherein the rigid extension of said arm (7*b*) is realized by:

said arm (7*b*) of the spine (2) being longer than the other arm (7*a*), wherein the layer of glue (13) is applied onto or on a level of an extended part of said arm (7*b*); or by:

attaching the cover sheet (4) to said arm (7*b*) with a rigid or stiff adhesion (9), wherein the layer of glue (13) is applied on a level of this rigid or stiff adhesion (9);

wherein the binding folder is provided with two cover sheets (3, 4), wherein a first cover sheet (3) is attached to a first arm (7*a*) with a flexible adhesion (8), such that this first cover sheet can be folded open relative to said first arm (7*a*), wherein the second cover sheet (4) is attached to the second arm (7*b*), wherein on this second arm (7*b*) or on a rigid extension thereof, said layer of glue (13) is applied;

wherein the flexible adhesion (8) is realised because the first cover sheet is located (3) in an extension of the first arm (7*a*), wherein a coating (18) is provided at least around the first cover sheet (3) and first arm (7*a*), such that between the first arm (7*a*) and the first cover sheet (3) a hinge is created.

* * * * *